US007131843B1

(12) United States Patent
Tang

(10) Patent No.: US 7,131,843 B1
(45) Date of Patent: Nov. 7, 2006

(54) JOINT SYSTEM

(75) Inventor: John Gee Tang, San Carlos, CA (US)

(73) Assignee: Lucesco Lighting, Inc., Palo Alto, CA (US)

( * ) Notice: Subject to any disclaimer, the term of this patent is extended or adjusted under 35 U.S.C. 154(b) by 0 days.

(21) Appl. No.: 11/004,514

(22) Filed: Dec. 3, 2004

(51) Int. Cl.
*H01R 39/00* (2006.01)

(52) U.S. Cl. ..... 439/11; 439/669

(58) Field of Classification Search ..... 439/11–14, 439/18, 668, 669
See application file for complete search history.

(56) References Cited

U.S. PATENT DOCUMENTS

| | | | | |
|---|---|---|---|---|
| 2,458,967 | A | 1/1949 | Wiedenhoeft | |
| 3,790,773 | A | 2/1974 | Sapper | |
| 4,472,010 | A * | 9/1984 | Parnello | 439/14 |
| 4,494,177 | A | 1/1985 | Matthews | |
| 4,772,993 | A | 9/1988 | Engel | |
| 5,049,081 | A | 9/1991 | Ribitsch et al. | |
| 5,235,500 | A | 8/1993 | Sapper | |
| 5,332,181 | A | 7/1994 | Schweizer et al. | |
| 5,790,307 | A | 8/1998 | Mick et al. | |
| 6,394,634 | B1 | 5/2002 | Kitchin | |
| 6,790,046 | B1 * | 9/2004 | Haffenden et al. | 439/6 |

FOREIGN PATENT DOCUMENTS

| | | |
|---|---|---|
| DE | 86 03 797 U1 | 6/1986 |
| DE | 201 05 914 U1 | 6/2001 |
| DE | 102 32 531 A1 | 10/2003 |

OTHER PUBLICATIONS

Marisa Bartolucci, "Let there be L.E.D.", *The New York Times Style Magazine*, Spring 2005, 4 pages.
Peter Hall, "Desktop Comet", *Metropolis—Architecture<Culture> Design*, Apr. 2005, 10 pages.
Cecilia Fabiani, "OLIVARI: Richard Sapper . . . designers: technically complex products with a capacity to communicate . . . ", *OLIVARI Concept by Think*, 1998-2000, 4 pages.
Artemide, "*Select the Tizio of your choice*", http://www.artemidestore.com/?page=1_tiziomodelselection/index Oct. 11, 2004, 1 page.
PCT Search Report and Written Opinion for PCT/US2005/042862, mailed Mar. 29, 2006, 12 pages.

* cited by examiner

*Primary Examiner*—Khiem Nguyen
(74) *Attorney, Agent, or Firm*—Blakely, Sokoloff, Taylor & Zafman LLP

(57) ABSTRACT

An apparatus for movably joining structures is disclosed. In one embodiment of the invention, the apparatus provides at least one rotational degree of freedom of movement, while providing electrical coupling. In another embodiment of the invention, the apparatus provides at least two rotational degrees of freedom of movement.

21 Claims, 17 Drawing Sheets

JOINT SYSTEM

FIELD OF INVENTION

The field of the invention relates to joint structures, and more particularly joint structures that provide multiple degrees of freedom of motion.

BACKGROUND

Generally, a joint is a configuration by which two or more parts are joined. Many kinds of joints exist, such as fixed joints, rotational joints and translational joints. A fixed joint locks two parts together so that they cannot move with respect to each other. A rotational joint, on the other hand, allows the rotation of one part with respect to another part about a common axis. A translational joint allows one part to translate along a vector relative to another part.

Joint structures are classified into various categories depending on the field of study. For example, in anatomy, joints are classified as fibrous, cartilaginous and synovial. These categories classify anatomical joints based upon the magnitude of motion the joint permits. Fibrous joints allow no movement, cartilaginous joints allow a small magnitude of movement, and synovial joints allow the largest magnitude of movement. In robotics, on the other hand, joints are classified as revolute, prismatic, helical, cylindrical, spherical and planar. These categories classify robotic joints based upon the types of motion the joint permits. Joints may also be classified based upon the degrees of freedom of motion the joint permits.

In mechanical engineering, degrees of freedom (DOF) describe flexibility of motion. A mechanism that has complete freedom of motion, even if only in a limited space, has six degrees of freedom. Three modes are translational, each moving in one of three spacial dimensions (e.g. x, y, and z). Three modes are rotational, each changing angles around one of three perpendicular axes. The six degrees of freedom are often described as moving up and down (or heaving), moving left and right (or swaying), moving forward and backwards (or surging), tilting up and down (or pitching), turning left and right (or yawing), and tilting side to side (or rolling).

A single joint structure may provide zero degrees of freedom (e.g. fixed or fibrous joints), one of the six degrees of freedom (e.g. rotational or translational joints) or a combination of the six degrees of freedom delineated above (e.g. synovial joints). Additionally, a combination of joint structures may provide complete freedom of motion.

BRIEF DESCRIPTION OF THE DRAWINGS

Various aspects of the present invention are set forth in the following drawings in which.

DETAILED DESCRIPTION

An apparatus for movably joining mechanical parts is disclosed. In the following detailed description, numerous specific details are set forth in order to provide a thorough understanding of the present invention. However, it will be apparent to one of ordinary skill in the art that these specific details need not be used to practice the present invention. In other circumstances, well-known structures, materials, or processes have not been shown or described in detail in order not to obscure unnecessarily the present invention.

A rotatable joint is a joint structure permitting at least one part coupled to the joint to rotate relative to at least another part coupled to the joint. A rotational joint is a rotatable joint. A joint structure providing multiple degrees of freedom may be a rotable joint if it provides at least pitch, yaw or roll.

Figure 1A:
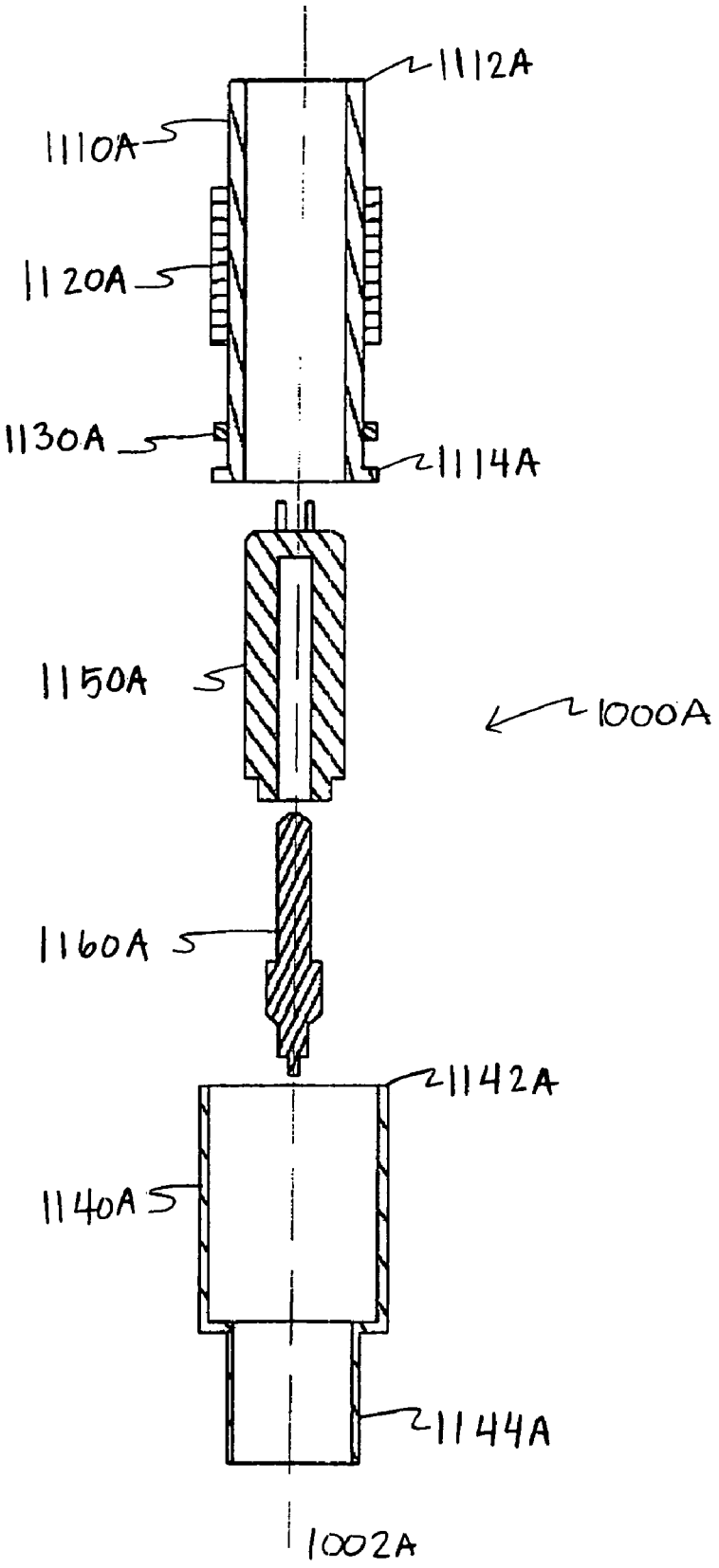
FIG. 1A is a cross-sectional view of components of a rotable joint in accordance with one embodiment of this invention.

FIG. 1A is a cross-sectional view of components of a rotable joint in accordance with one embodiment of this invention. Barrel housing 1110A is generally cylindrical and has two ends 1112A, 1114A. The outer diameter of barrel housing 1110A is smaller than the inner diameter of transition housing 1140A, so that barrel housing end 1114A will fit through transition housing end 1142A. In one embodiment, end 1114A has a larger outer diameter than end 1112A to restrict translational movements of bushing 1120A and spring wave washer 1130A on barrel housing 1110A along axis 1002A.

Barrel housing 1110A is hollow to permit electrical connector 1150A and 1160A to be disposed inside barrel housing 1110A once the components of FIG. 1A are assembled. In one embodiment, the inner surface of barrel housing 1110A is cylindrical, so that a cross-section of the inner surface of barrel housing 1110A is circular. In one embodiment, the diameter of this inner surface is approximately 8-mm. In another embodiment, the cross-section of this inner surface is non-circular (e.g. rectangular). Barrel housing 1110A may be composed of a variety of solid materials, e.g. aluminum or plastic.

In one embodiment, barrel housing 1110A extends approximately 20-mm lengthwise. Barrel housing 1110A is longer than bushing 1120A, such that the length of bushing 1120A may fit on barrel housing 1110A. Bushing 1120A and spring wave 1130A are disposed around the external surface of barrel housing 1110A.

Bushing 1120A is capable of rotating around barrel housing 1110A about axis 1002A. The internal surface of bushing 1120A contacts frictionally with the external surface of barrel housing 1110A. The static and kinetic coefficient of friction between bushing 1120A and barrel housing 1110A is sufficiently low to permit ready movement of bushing 1120A around barrel housing 111A. In one embodiment, barrel housing 1110A is aluminum and bushing 1110A is either nylon or acetal (e.g. delrin).

Figure 1B:
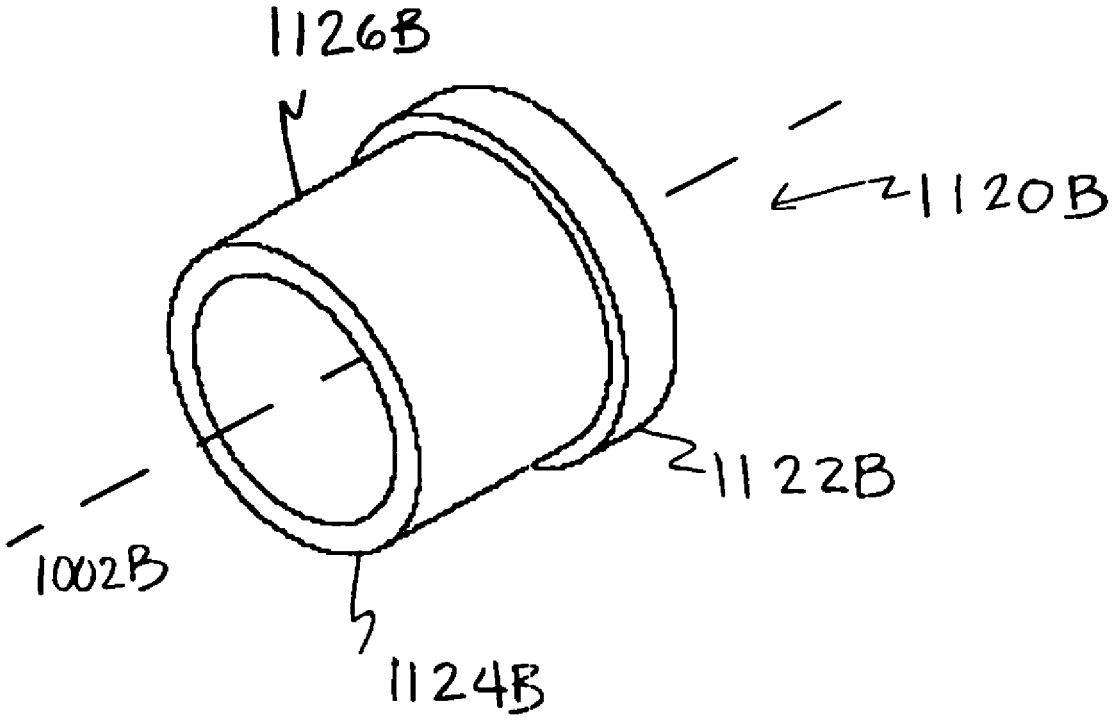
FIG. 1B is a perspective view of a bushing in accordance with one embodiment of this invention.

FIG. 1B is a perspective view of a bushing in accordance with one embodiment of this invention. Bushing 1120B has opposing ends 1122B, 1124B. In one embodiment, end 1122B and 1124B has approximately the same outer diameter. In the embodiment shown in FIG. 1B, end 1122B has a larger outer diameter than end 1124B, such that a cross-section of end 1122B has a larger surface area than a cross-section of end 1124B. In one embodiment, end 1122B extends approximately 2.5-mm deep and has an outer diameter of approximately 14-mm, and an inner diameter of approximately 10-mm, while end 1124B (and the rest of bushing 120B between ends 1122B and 1124B) has an outer diameter of approximately 12.5-mm and an inner diameter of approximately 10-mm. The outer diameter of bushing end 1124A is less than or equal to the inner diameter of transition housing 1140A, such that bushing end 1124A fits into transition housing 1140A through transition housing end 1142A. In one embodiment, bushing 1120B extends approximately 12-mm in length.

In the embodiment shown in FIG. 1B, outer surface 1126B of bushing 1120B is unthreaded. In one embodiment, outer surface 1126B adheres to transition housing 1140A using an adhesive (e.g. two-part epoxy). In another embodiment, outer surface 1126B press fits into transition housing 1126B. In another embodiment, outer surface 1126B has threads, corresponding to threads on the internal surface of transition housing 1126B, that allow bushing 1120B to be essentially screwed into transition housing 1126B.

In one embodiment, end 1122B is disposed adjacent to a structure to which the joint attaches. Once assembled, friction between the structure and the bushing end provides a dampening force when bushing 1120A rotates relative to the barrel housing. In one embodiment, the structure to which the joint attaches has a cylindrical opening into which barrel housing end 1112A fits. In another embodiment, the structure to which the joint attaches has a cylindrical protrusion that fits into barrel housing end 1112A, coupling the structure to barrel housing 111A. In such an embodiment, a frictional washer may be desirable. In embodiments having frictional washer, the frictional washer may be disposed adjacent to end 1122B, such that the frictional contact between the frictional washer and the bushing end provides a dampening force. The frictional washer may also provide a restrictive force, preventing the bushing from moving translationally along axis 1002A.

In FIG. 1A, spring washer 1130A also provides a restrictive force. Spring washer 1130A fits around barrel housing 1110A, and provides a force along axis 1002A to restrict translational movements of bushing 1120A along axis 1002A. In the embodiment show in FIG. 1, once assembled, spring washer 1130A frictionally contacts bushing 1120A. Opposing forces along axis 1002A compress spring washer 1130A such that the spring washer remains substantially fixed when bushing 1120A rotates relative to barrel housing 1110A. Friction between the surface of spring washer 1130A and bushing 1120A also provides a dampening force when bushing 1120A rotates relative to the barrel housing. In one embodiment, spring washer 1130A is a wave spring washer. In another embodiment, spring washer 1130A is a Belleville spring washer. In one embodiment, spring washer 1130A is metal (e.g. steel).

In another embodiment, to further prevent rotation of spring washer 1130A, a frictional washer is also disposed between spring washer 1130A and bushing 1120A. In one embodiment, the barrel housing has a cross-sectional shape similar to the letter "D" and the frictional washer has a hole with a matching cross-section, such that, once disposed around the barrel housing, the frictional washer remains substantially fixed relative to barrel housing. This configuration assists the spring washer (frictionally contacting the frictional washer) to remain fixed relative to the barrel housing.

The outer diameter of spring washer 1120A is less than or equal to the inner diameter of transition housing 1140A. The inner diameter of spring washer 1120A is greater than or equal to the outer diameter of barrel housing 1110A between ends 1112A and 1114A, but may be less than the outer diameter of end 1114A. In one embodiment, spring washer 1130A has an outer diameter of approximately 12.5-mm and an inner diameter of approximately 10-mm.

Transition housing 1140A has opposing ends 1142A, 1144A. The inner diameter of transition housing 1140A at transition housing end 1142A is greater than or equal to the outer diameter of barrel housing end 1114A, so that transition housing end 1142A will fit over barrel housing end 1114A. In one embodiment, transition housing end 1144A has a smaller outer diameter than transition housing end 1142A, so as to correlate with dimensions of a structure to be attached to the joint. For example, if a hollow rod with a small inner diameter is to attach to the joint axially at transition housing 1140A, end 1144A may have an equally smaller outer diameter to correlate to the inner diameter of the hollow rod. In one embodiment, transition housing end 1142A has an inner diameter of approximately 12.5-mm, transition housing end 1144A has an inner diameter of approximately 7-mm, and barrel housing end 1114A has an outer diameter of approximately 12.5-mm. In one embodiment, transition housing 1140A extends about 30-mm in length, including an end 1144A that extends about 10-mm. In one embodiment, transition housing 1140A is metal (e.g. aluminum).

In embodiments in which transition housing end 1144A has a cylindrical outer surface, a mechanical structure, e.g. a pipe, may fit axially around end 1144A, coupling the structure to transition housing 1140A. In embodiments in which transition housing end 1144A has a cylindrical inner surface, a mechanical structure, e.g. a pipe, may fit axially inside end 1144A, again coupling the structure to transition housing 1140A. In another embodiment, the mechanical structure has an opening into which transition housing end 1144A couples. In another embodiment, the mechanical structure has a protrusion over which transition housing end 1144A couples.

In another embodiment, the mechanical structure has dimensions such that a transition housing is not required for the mechanical structure to attach to the joint. For example, the mechanical structure may be a pipe capable of fitting directly over bushing 1120A, thereby eliminating the need for a transition housing.

In the embodiment of FIG. 1, once assembled, electrical connector 1160A is disposed inside transition housing 1140A. In one embodiment, electrical connector 1160A press fits into transition housing 1140A. Other known mechanical methods of coupling the electrical connector to the transition housing are also within the scope of this invention, such as coupling through adhesives. In one embodiment, rotation of transition housing 1140A about axis 1002A results in simultaneous rotation of electrical connector 1160A (such as in embodiments wherein connector 1160A couples to transition housing 1140A with adhesive.) The body of connector 1160A may be a variety of shapes. For example, in one embodiment, connector 1160A may have a square body. In such embodiments, transition housing 1140A (or a structure coupling directly to the joint), may have a mating structure corresponding to the square body.

Electrical connector 1160A couples to electrical connector 1150A. Electrical connector 1160A is capable of rotating relative to electrical connector 1150A about axis 1002A. While rotating, connector 1160A is capable of maintaining electrical connectivity with connector 1150A.

In one embodiment, electrical connector 1150A is a jack (e.g. a 2.5-mm jack) and electrical connector 1160A is a plug (e.g. a 2.5-mm plug). In another embodiment, electrical connector 1150A is a plug and electrical connector 1160A is a jack. In one embodiment, electrical connectors 1150A, 1160A are corresponding coaxial cable caps (or ends). In another embodiment, electrical connectors 1150A, 1160A couple to each other via a pin-and-slot mechanism that permits the connectors to rotate less than 360 degrees relative to each other about axis 1002A.

Electrical connectors 1150A, 1160A may have any number of conductors (e.g. one conductor, or at least two conductors). For example, in one embodiment, the electrical connectors have three conductors and may be used in, e.g., audio equipment. In another embodiment, the electrical connectors have four conductors and may be used in, e.g., lighting fixtures.

Electrical connector 1150A is disposed partially inside barrel housing 1110A. In one embodiment, connector 1150A press fits into barrel housing 1110A. At the widest cross-section, connector 1150A is smaller or equal in diameter to the inner diameter of barrel housing 1110A, such that connector 1150A fits inside barrel housing 1110A. In one embodiment, the widest cross-section of connector 1150A is approximately 8-mm, and the inner diameter of barrel housing 1110A is approximately 8-mm. In one embodiment, rotation of barrel housing 1110A about axis 1002A results in simultaneous rotation of electrical connector 1150A, e.g. in embodiments wherein at least a portion of connector 1150A is coupled to barrel housing 1112A with adhesive (or other similar methods).

Figure 1C:
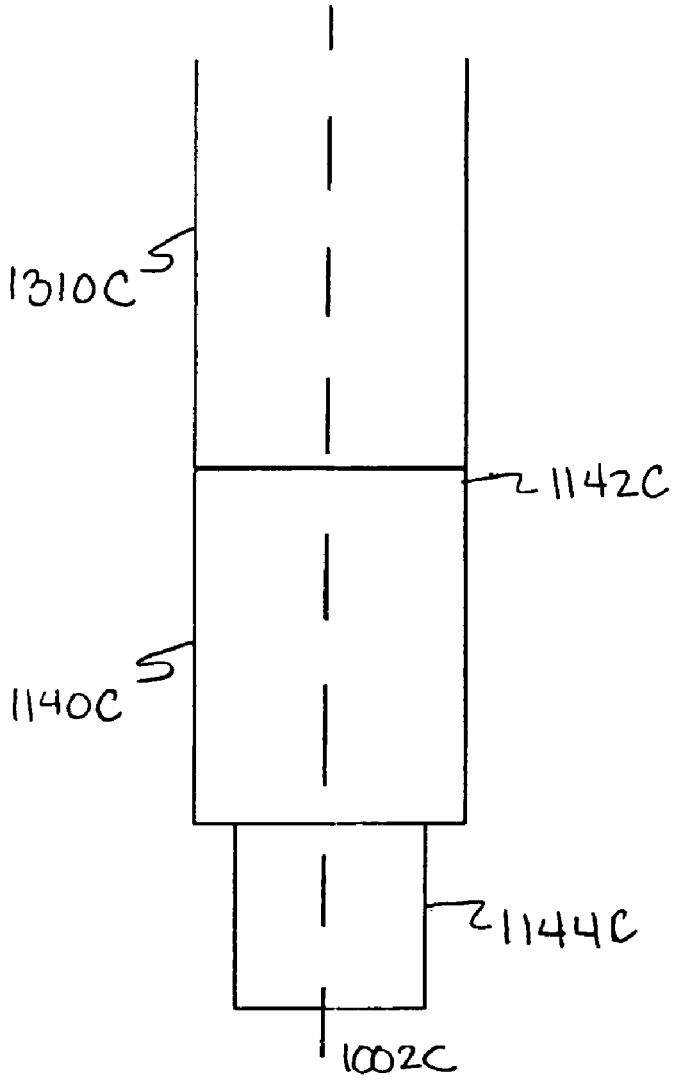
FIG. 1C is a side view of the components of FIG. 1A assembled with a structure.

FIG. 1C is a side view of the components of FIG. 1A assembled with mechanical structure 1310C. Here, mechanical structure 1310C is a hollow rod fitting axially over barrel housing end 1112A. In another embodiment, mechanical structure 1310C has an opening into which barrel housing end 1112A fits. In another embodiment, structure 1310C has a protrusion that fits into barrel housing end 1112A.

In one embodiment, electrical connector 1160A fits into electrical connector 1150A, which fits into barrel housing 1110A. Thus, neither electrical connector 1150A nor electrical connector 1160A are exposed. Barrel housing 1110A, along with spring washer 1130A and bushing 1120A, fits inside transition housing 1140C. Transition housing 1140C envelops barrel housing end 1114A, spring wave 1130A and bushing 1120A, resulting in a joint structure in accordance with this invention. When electrical connector 1150A is a jack and electrical connector 1160A is a plug, a cross-section through bushing 1120A of joint 1000A (assembled) would result in concentric layers, from the outside inward, of the transition housing 1140A, bushing 1110A, barrel housing 1110A, electrical connector 1150A and electrical connector 1160A. The joint of this embodiment provides both continual electrical connectivity and a rotational degree of freedom to parts coupled to the joint (e.g. mechanical structure 1310C) through the capability of bushing 1120A to rotate relative to barrel housing 1110A, and the capability of electrical connector 1150A to rotate relative to electrical connector 1160A. Thus, a part fixedly coupled to transition housing 1140C is capable of rotating relative to a structure 1310C, which is fixedly coupled to barrel housing 1110A. Such a part may also be electrically coupled to structure 1310C via electrical connectors 1150A and 1160A.

In the embodiment of FIG. 1C, transition housing 1140C is capable of rotating any number of degrees clockwise or counterclockwise relative to structure 1310C. In another embodiment, transition housing 1140C may only rotate a limited number of degrees in one direction before it can only rotate in the other direction. In one embodiment, this limitation is imposed by electrical connectors 1160A, 1150A. For example, if electrical connectors 1160A, 1150A are corresponding coaxial connectors, the thread count in the connectors may limit the number of clockwise and counterclockwise rotations. In another embodiment, this limitation is imposed by a stop added to the joint. In another embodiment, transition housing 1140C is capable of rotating less than 360 degrees either clockwise or counterclockwise. In one embodiment, this limitation is imposed by electrical connectors 1160A, 1150A. For example, if electrical connectors 1160A, 1150A are coupled to each other using a pin-and-slot mechanism, the slot's arclength may limit degrees of rotation.

In one embodiment, at least one electrical connector 1150A or 1160A attaches to a rigid rod with a conductive core, through which an electrical signal travels. In another embodiment, at least one electrical connector 1150A or 1160A attaches to a cable through which an electrical signal travels. In those embodiments, the joint provides rotational motion without significantly stressing the cable mechanically.

For example, in one embodiment, a cable is soldered to electrical connector 1160A, which press fits into transition housing 1140A. Electrical connector 1160A rotatably couples to electrical connector 1150A. Therefore, as transition housing 1140C rotates relative to barrel housing 1110A, electrical connector 1160A also rotates. Thus, the cable fixedly attached to electrical connector 1160A remains stationary relative to the transition housing. The cable need not twist, stretch nor bunch as a result of the rotation because electrical connector 1160A is also capable of rotating. If the cable is partially housed in a rod that attaches to transition housing 1140A, the cable will remain stationary relative to the rod as well, neither twisting nor stretching nor bunching inside the rod as the rod rotates. Electrical connectors 1150A and 1160A are capable of maintaining electrical connectivity while rotating relative to each other. Therefore, joint 1000A provides continued electrical connectivity during rotation.

Thus, the joint of this embodiment is capable of mechanically and electrically coupling distinct parts. The joint of this embodiment provides a rotational degree of freedom of motion while maintaining electrical connectivity throughout the range of movement between electrical parts coupled to the joint. This electrical connectivity is maintained during movement without significantly mechanically stressing the components that facilitate the electrical coupling, e.g. a cable.

Figure 2A:
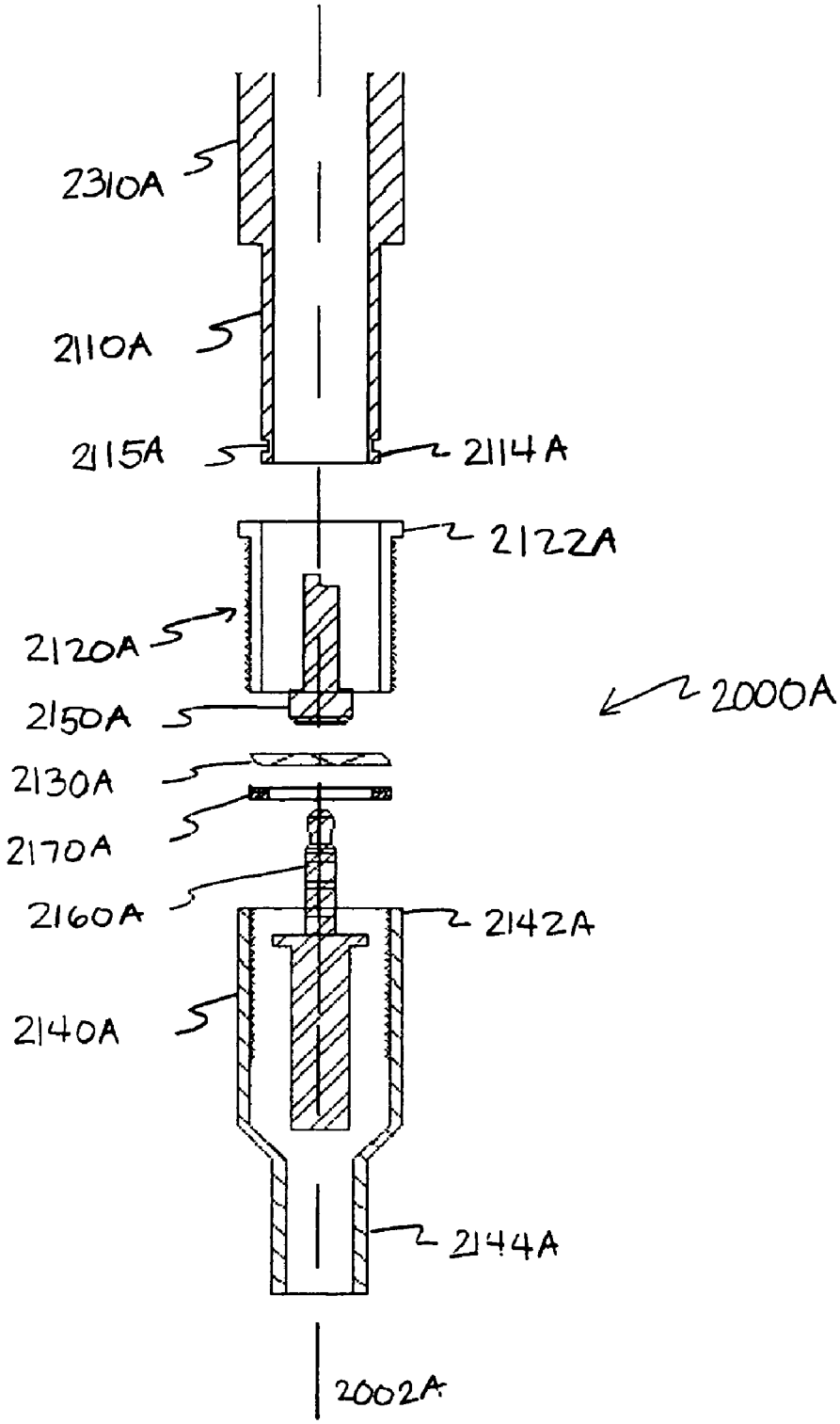
FIG. 2A is a cross-sectional view of components of a rotable joint in accordance with another embodiment of this invention.

FIG. 2A is a cross-sectional view of components of a rotable joint in accordance with another embodiment of this invention. In this embodiment, barrel housing 2110A is part of, rather than initially detachable from, structure 2310A. In one embodiment, barrel housing 2110A has an outer diameter of about 10-mm and an inner diameter of about 8-mm.

Groove 2115A near barrel housing end 2114A is sufficiently deep and wide to secure retaining ring 2170A to barrel housing 2110A. In one embodiment, the shell of barrel housing 2110A is 2-mm thick and groove 2115A is approximately 0.08-mm deep and 0.40-mm wide.

When the components of joint 2000A are assembled, retaining ring 2170A fits into groove 2115A. Retaining ring 2170A has an inner diameter smaller than the outer diameter of barrel housing 2110A and an outer diameter larger than the outer diameter of barrel housing 2110A, but smaller or equal to the inner diameter of transition housing 2140A. Retaining ring 2170A restricts translational movement of spring wave 2130A and bushing 2120A along axis 2002A on barrel housing 2110A. In one embodiment, retaining ring is metal (e.g. steel).

As assembled, bushing 2120A is disposed around barrel housing 2110A. In one embodiment, bushing end 2122A is adjacent to structure 2310A. In another embodiment, bushing end is adjacent to a frictional washer (not shown), which is adjacent to structure 2310A. As previously described, the frictional contact between a frictional washer and the bushing end may provide a desirable dampening force. The frictional washer may also provide a restrictive force, preventing the bushing from moving translationally along an axis (here axis 2002A.) In the embodiment of FIG. 2A, bushing 2120A is externally threaded. The threads on bushing 2120A correspond to internal threads in transition housing 2140A.

Transition housing 2140A has a varying inner diameter. In one embodiment, transition housing end 2144A has a smaller inner diameter than transition housing end 2142A, such that end 2144A restricts translational movements of barrel housing 2110A along axis 2002A in the assembled joint of FIG. 2A. In one embodiment, electrical connector 2160A press fits into the smaller diameter transition housing end 2144A and couples to electrical connector 2150A, which couples to structure 2310A. In one embodiment, electrical connector 2160A press fits into structure 2310A.

Figure 2B:
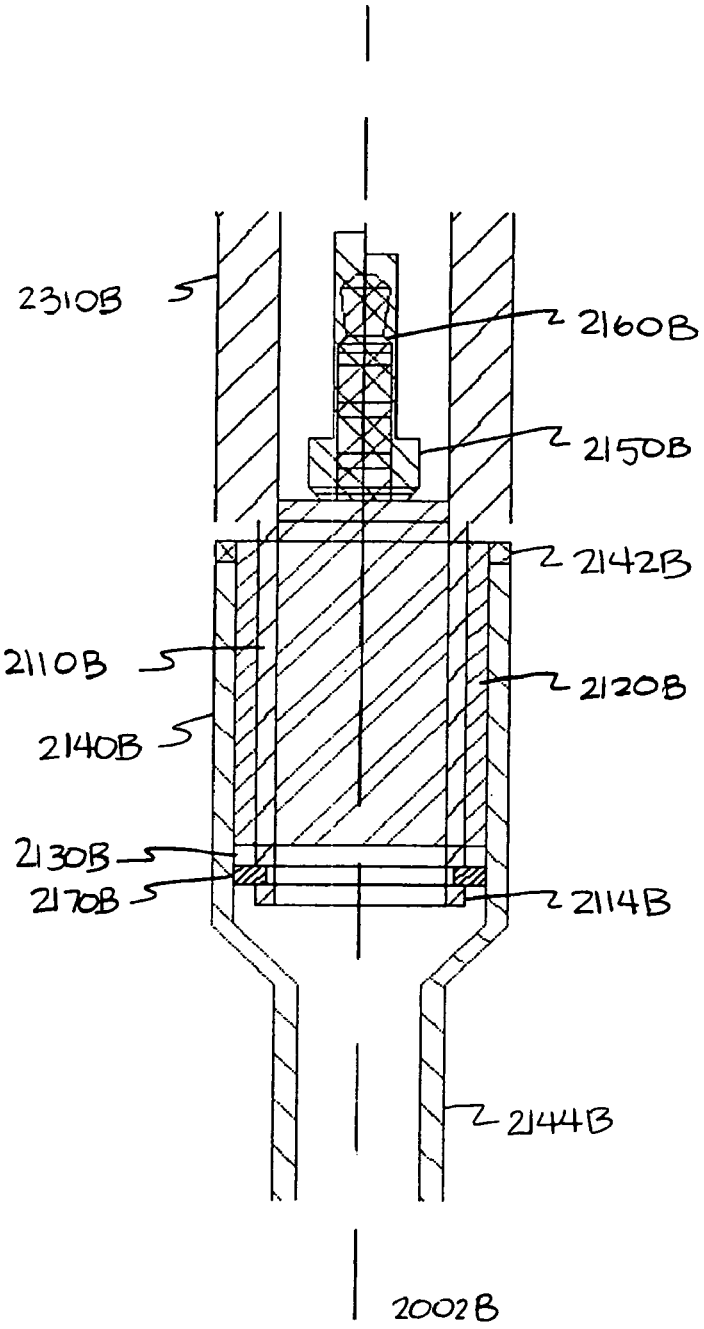
FIG. 2B is a cross-sectional view of the components of FIG. 2A assembled.

FIG. 2B is a cross-sectional view of the components of FIG. 2A assembled. The threads of transition housing 2140B couple to the threads of bushing 2120B. Bushing 2120B is capable of rotating relative to barrel housing 2110B along axis 2002B. Electrical connector 2160B attaches to the inside transition housing 2140B and couples to electrical connector 2150B, which is attached to the inside structure 2310B. Electrical connector 2160B is capable of rotating relative to connector 2150B along axis 2002B when bushing 2120B rotates around barrel housing 2110B. Again, the joint of this embodiment is capable of mechanically and electrically coupling distinct parts. The joint of this embodiment provides a rotational degree of freedom of motion while maintaining electrical connectivity throughout the range of movement between electrical parts coupled to the joint. This electrical connectivity is maintained during movement without significantly mechanically stressing the components that facilitate the electrical coupling, e.g. a cable that attaches to electrical connector 2150B or 2160B.

Figure 3A:
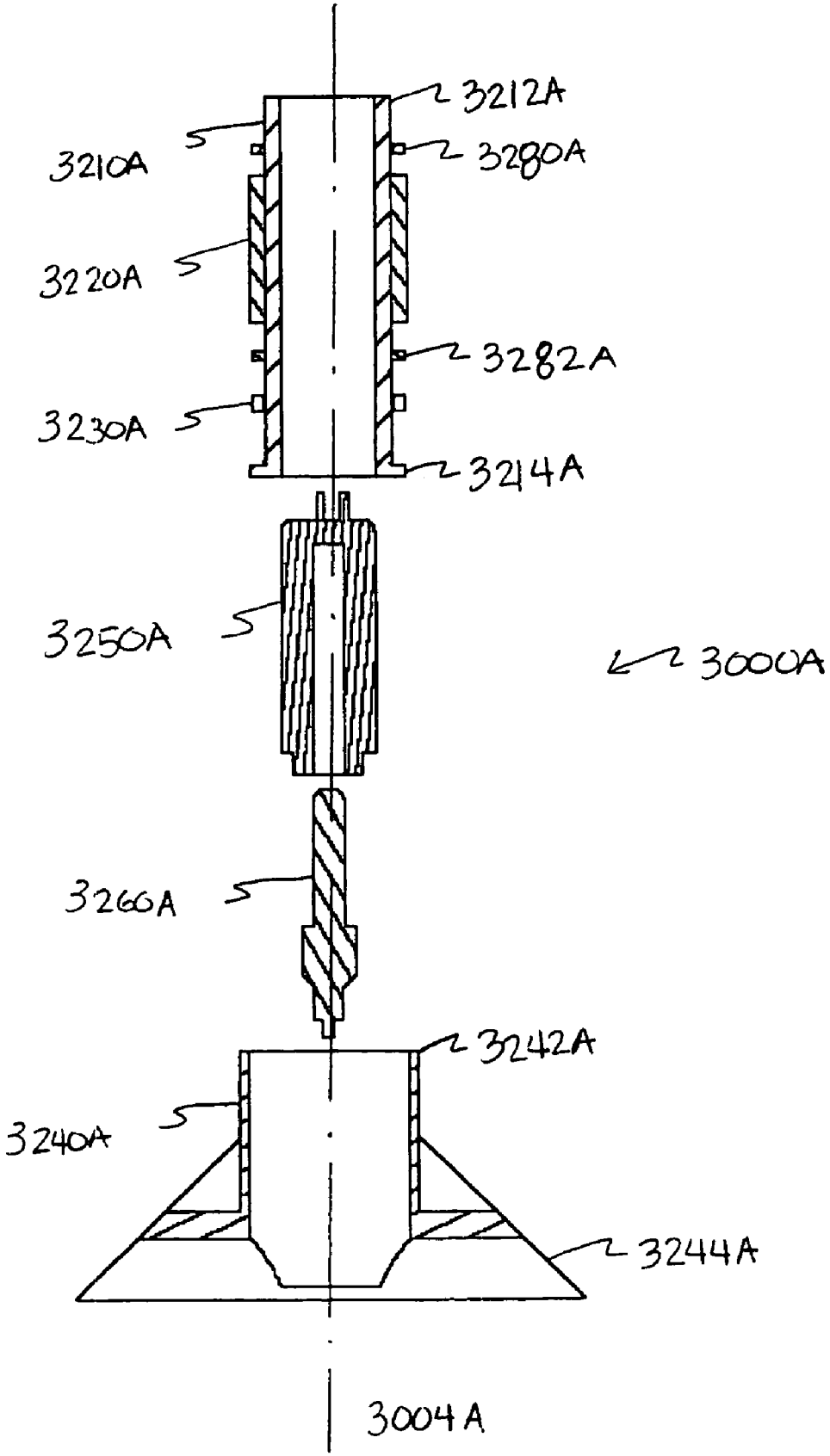
FIG. 3A is a cross-sectional view of components of a rotable joint in accordance with another embodiment of this invention.

FIG. 3A is a cross-sectional view of components of a rotable joint in accordance with another embodiment of this invention. Here, transitional housing 3240A includes gusset 3244A to facilitate attachment to a structure (not shown). In one embodiment, the gusset attaches to the outside surface of a rod such that the lengthwise axis of the rod is perpendicular to axis 3004A.

Fictional washer 3280A is disposed around barrel housing 3210A, adjacent to bushing 3220A. In one embodiment, a structure has an opening into which barrel housing 3210A fits. In such an embodiment, friction washer 3280A is adjacent to the structure, and provides a larger frictional surface area with which bushing 3220A may contact. Frictional washer 3280A may also further restrict translational movements of bushing 3220A and spring washer 3230A along axis 3004A. Between bushing 3220A and spring washer 3230A is another frictional washer 3282A. Frictional washer 3282A also provides a larger frictional surface area and may further restrict translational movements of bushing 3220A and spring washer 3230A along axis 3004A. In one embodiment, the frictional washers are metal (e.g. steel or aluminum). In another embodiment, the frictional washers are rubber or plastic.

Figure 3B:
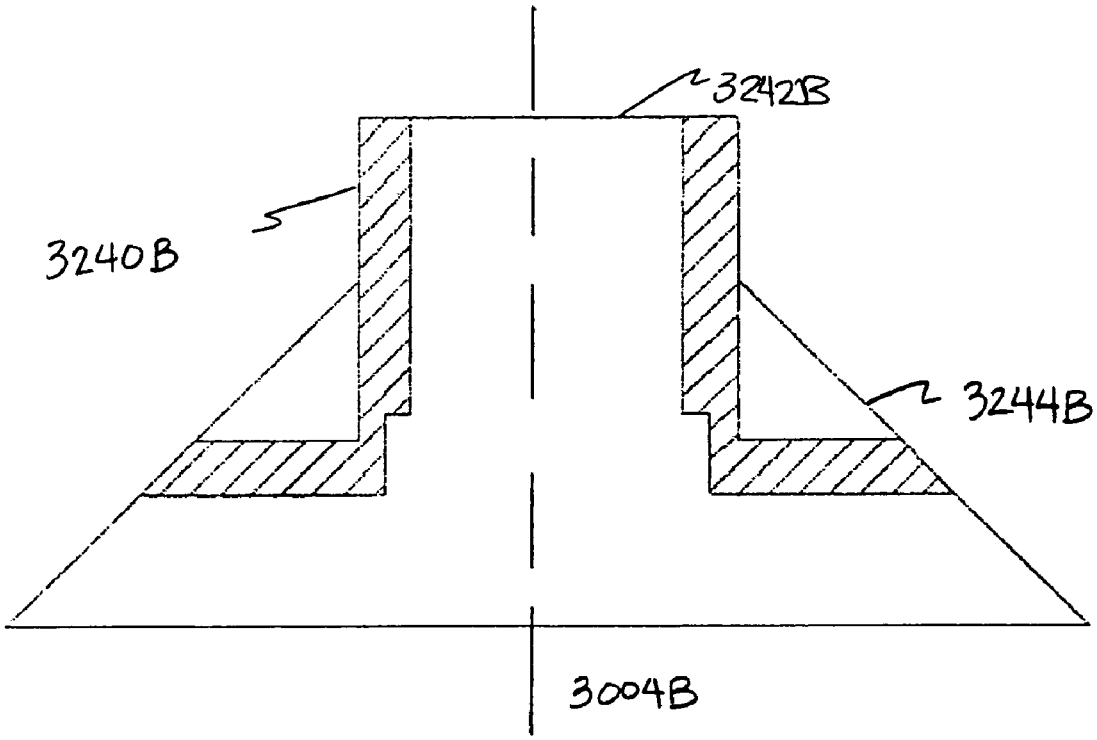
FIG. 3B is a cross-sectional view of a transition housing including a gusset in accordance with one embodiment this invention.

FIG. 3B is a cross-sectional view of a transition housing including a gusset. A barrel housing (not shown) fits into transition housing end 3242B. In this embodiment, the inner diameter of transition housing 3240B widens near an end opposite end 3242B. In another embodiment, the inner diameter of transition housing 3240B remains constant. In another embodiment, the inner diameter of transition housing 3240B narrows (as shown in transition housing 4240A in FIG. 4A.) Gusset 3244B secures a structure (not shown) to transition housing 3240A.

Figure 3C:
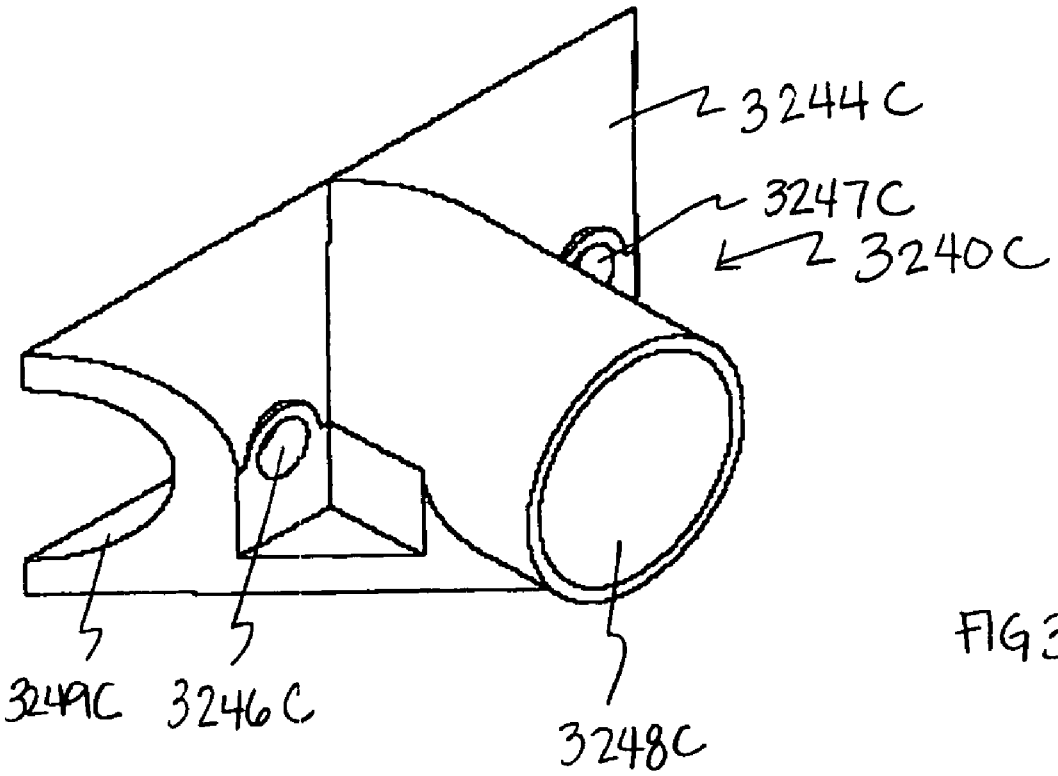
FIG. 3C is a perspective view of a transition housing with a gusset in accordance with another embodiment this invention.

FIG. 3C is a perspective view of a transition housing with a gusset in accordance with another embodiment of this invention. A bushing surrounding a barrel housing fits inside opening 3248C. Openings 3246C, 3247C allow fasteners (e.g. screws or nails) to couple transition housing 3240C to a structure (not shown). Any number of openings may be provided to fasten the transition housing to the structure and still remain within the scope of this invention. In one embodiment, the structure attaches to the gusset using adhesive, making openings unnecessary. In another embodiment, the structure attaches to the gusset using both adhesives and fasteners.

Surface 3249C forms a channel. A cross-section of the channel may form a variety of shapes, including a rectangular or semi-circular shape. In the embodiment of FIG. 3C, surface 3249C forms a channel with a semi-circular cross-section. A cylindrical rod, or a semi-cylindrical protrusion on a non-cylindrical structure, may fit into the channel. Adhesives and/or fasteners may be used to secure the structure inside the channel. In another embodiment, surface 3249C forms a channel with a cross-section that forms an arc with a radial angle of greater than 180 degrees. In such an embodiment, a cylindrical rod, or a near-cylindrical protrusion on a non-cylindrical structure, may snap-fit into the channel, such that adhesives and/or fasteners may not be required to secure the rod or structure inside the channel. Alternatively, in such an embodiment, the cylindrical rod, or a near-cylindrical protrusion on a non-cylindrical structure, may slide into the channel and be secured through friction between the contacting surfaces.

Figure 3D:
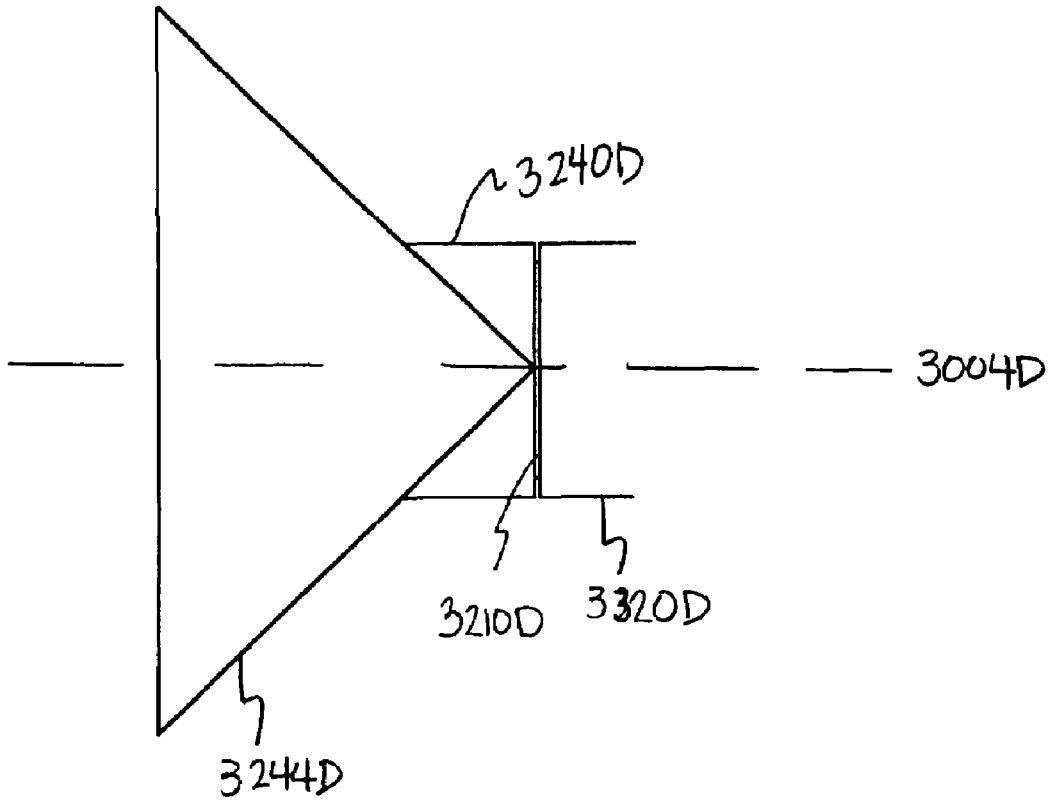
FIG. 3D is a side view of the components of FIG. 3A coupled with a structure.

FIG. 3D is a side view of the components of FIG. 3A assembled with mechanical structure 3320C. Transition housing 3240D is capable of rotating relative to structure 3320D along axis 3004D. Barrel housing 3210D is a separate component fitting into structure 3320D. Barrel housing 3210D may press fit into structure 3320D. In another embodiment, the barrel housing is fixedly coupled to structure 3320D using fasteners or adhesive. In another embodiment, the barrel housing is a protrusion of structure 3320D.

The embodiments of this invention shown in FIGS. 1A–3D provide for at least one degree of rotational freedom. The embodiments of this invention shown in FIGS. 4A–8 provide for at least two degrees of rotational freedom.

Figure 4A:
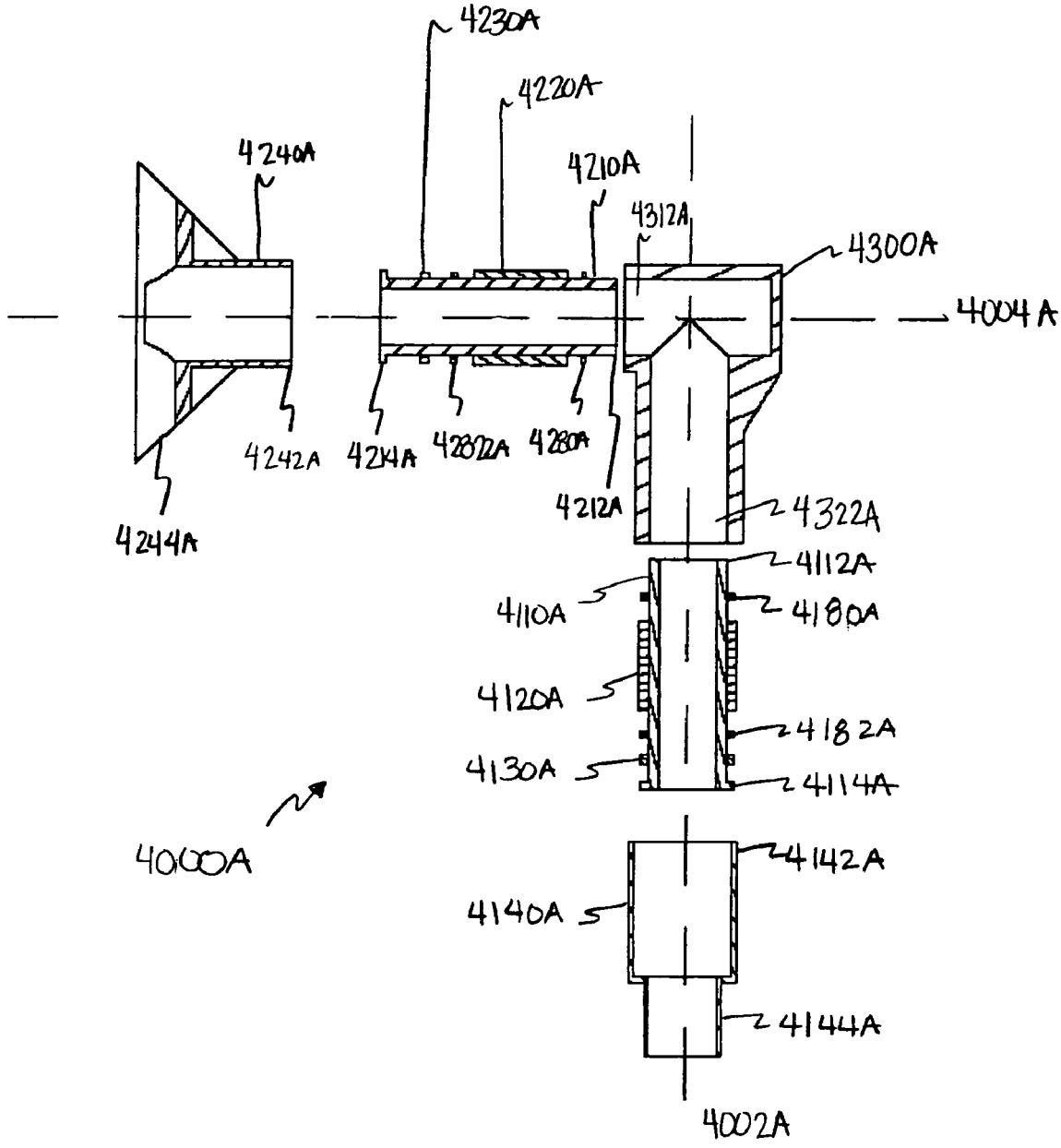
FIG. 4A is a cross-sectional view of components of a combination joint in accordance with one embodiment of this invention.

Specifically, FIG. 4A is a cross-sectional view of components in a combination joint in accordance with one embodiment of this invention. Combination joint 4000A provides two degrees of freedom, rotation around axis 4002A and rotation around axis 4004A. Center housing 4300A has opening 4322A along axis 4002A and opening 4312A along axis 4004A. In one embodiment, opening 4322A is perpendicular to opening 4312A. In one embodiment, center housing 4300A has a third opening (not shown), which is coaxial with opening 4312A, but smaller in diameter than opening 4312A. A rod may couple to the third opening using adhesives or friction. Alternatively, the third opening may be threaded to permit a threaded rod to couple to the center housing (with or without adhesives).

In one embodiment, the center housing is metal (e.g. aluminum). In one embodiment, the center housing is approximately 20.5-mm wide along axis 4004A, and approximately 39-mm wide along axis 4002A.

Barrel housing 4110A has opposing ends (4112A, 4114A). Barrel housing end 4112A couples (e.g. through adhesive or friction) to center housing 4300A inside opening 4322A. When the components of joint 4000A are assembled, center housing 4300A is adjacent to friction washer 4180A, which is adjacent to bushing 4120A, which is adjacent to friction washer 4182A. Friction washer 4182A is adjacent to spring washer 4130A, which is adjacent to barrel housing end 4114A.

In one embodiment, friction washers 4180A, 4182A may not be required to provide additional frictional surface area or to help restrict translation movements of bushing 4120A along axis 4002A. In one embodiment, barrel housing end 4114A has a larger outer diameter than the rest of barrel housing 4110A to restrict translational movements of spring washer 4130A and bushing 4120A on barrel housing 4110A along axis 4002A. In another embodiment, barrel housing end 4114A has the same outer diameter as the rest of barrel housing 4110A. In such an embodiment, a groove is formed near barrel housing end 4114A into which a retaining ring (not shown) is placed. The retaining ring restricts translational movements of spring washer 4130A and bushing 4120A on barrel housing 4110A along axis 4002A.

Transition housing 4140A surrounds spring washer 4130A, friction washer 4182A, bushing 4120A and friction washer 4180A. Transition housing 4140A may fixedly attach to bushing 4120A using known methods (e.g. through adhesive or friction). A structure (not shown) to which the joint is to be coupled may connect to transition housing end 4144A. In one embodiment, the structure couples axially along axis 4002A to transition housing 4140A. In another embodiment, the structure is capable of connecting directly to the combination joint, thereby making transition housing 4140A unnecessary.

Barrel housing 4210A also has opposing ends (4212A, 4214A). Barrel housing end 4212A couples (e.g. through adhesive or friction) to center housing 4300A inside opening 4312A. When the components of joint 4000A are assembled, center housing 4300A is adjacent to friction washer 4280A, which is adjacent to bushing 4220A, which is adjacent to friction washer 4282A. Friction washer 4282A is adjacent to spring washer 4230A, which is adjacent to barrel housing end 4214A.

In one embodiment, friction washers 4280A, 4282A may not be required to provide additional frictional surface area or to help restrict translation movements of bushing 4220A along axis 4004A. In one embodiment, barrel housing end 4214A has a larger outer diameter than the rest of barrel housing 4210A to restrict translational movements of spring washer 4230A and bushing 4220A on barrel housing 4210A along axis 4004A. In another embodiment, barrel housing end 4214A has the same outer diameter as the rest of barrel housing 4210A. In such an embodiment, a groove is formed near barrel housing end 4214A into which a retaining ring (not shown) is placed. The retaining ring restricts translational movements of spring washer 4230A and bushing 4220A on barrel housing 4210A along axis 4004A.

In the embodiment of FIG. 4A, transition housing 4240A surrounds spring washer 4230A, friction washer 4282A, bushing 4220A and friction washer 4280A. Transition housing 4240A may fixedly attach to bushing 4220A using known methods (e.g. through adhesive or frictional). Transition housing 4204A includes gusset 4214A, which couples to a mechanical structure (not shown). In one embodiment, the structure couples orthogonally to axis 4004A. In one embodiment, the structure is a cylindrical rod and the gusset couples to the external surface of the rod. In another embodiment, the structure is capable of connecting directly to the combination joint, thereby making transition housing 4240A unnecessary.

In one embodiment, the distance from one end of assembled combination joint 4000A (with gusset 4244A) to the opposite end of assembled combination joint 4000A (with center housing 4300A) along axis 4004A is approximately 36-mm, and the distance from one end of assembled combination joint 4000A (with transition housing end 4144A) to the opposite end of assembled combination joint 4000A (with center housing 4300A) along axis 4002A is between 40 to 50-mm.

Joint structure 4000A when assembled provides two degrees of freedom, one around axis 4002A and one around axis 4004A. Specifically, transition housing 4140A (and the parts coupled to it) are capable of rotating relative to center housing 4300A around axis 4002A. Transition housing 4240A (and the parts coupled to it) are capable of rotating relative to center housing 4300A around axis 4004A.

The rotational capabilities of the parts coupled to the transition housings 4140A, 4240A is dependent on the angle between axis 4002A and 4004A and the dimensions of the parts relative to the combination joint, as well as other coupled parts. To provide for maximum rotation, in at least certain embodiments, axis 4002A should be perpendicular to axis 4004A, and the parts coupled to the combination joint should be of such dimension and orientation as to not collide with each other. For example, if the parts coupled to the combination joint are cylindrical rods, then the parts will not collide if the first cylindrical rod is coupled to combination joint 4000A axially along 4002A and the second cylindrical rod is coupled to combination joint 4000A axially or orthogonally relative to axis 4004A. However, if the first cylindrical rod is coupled to combination joint 4000A orthogonally relative to axis 4002A, and the second cylindrical rod is coupled to combination joint 4000A orthogonally relative to axis 4004A, then the rods may collide, depending on their lengths.

Figure 4B:
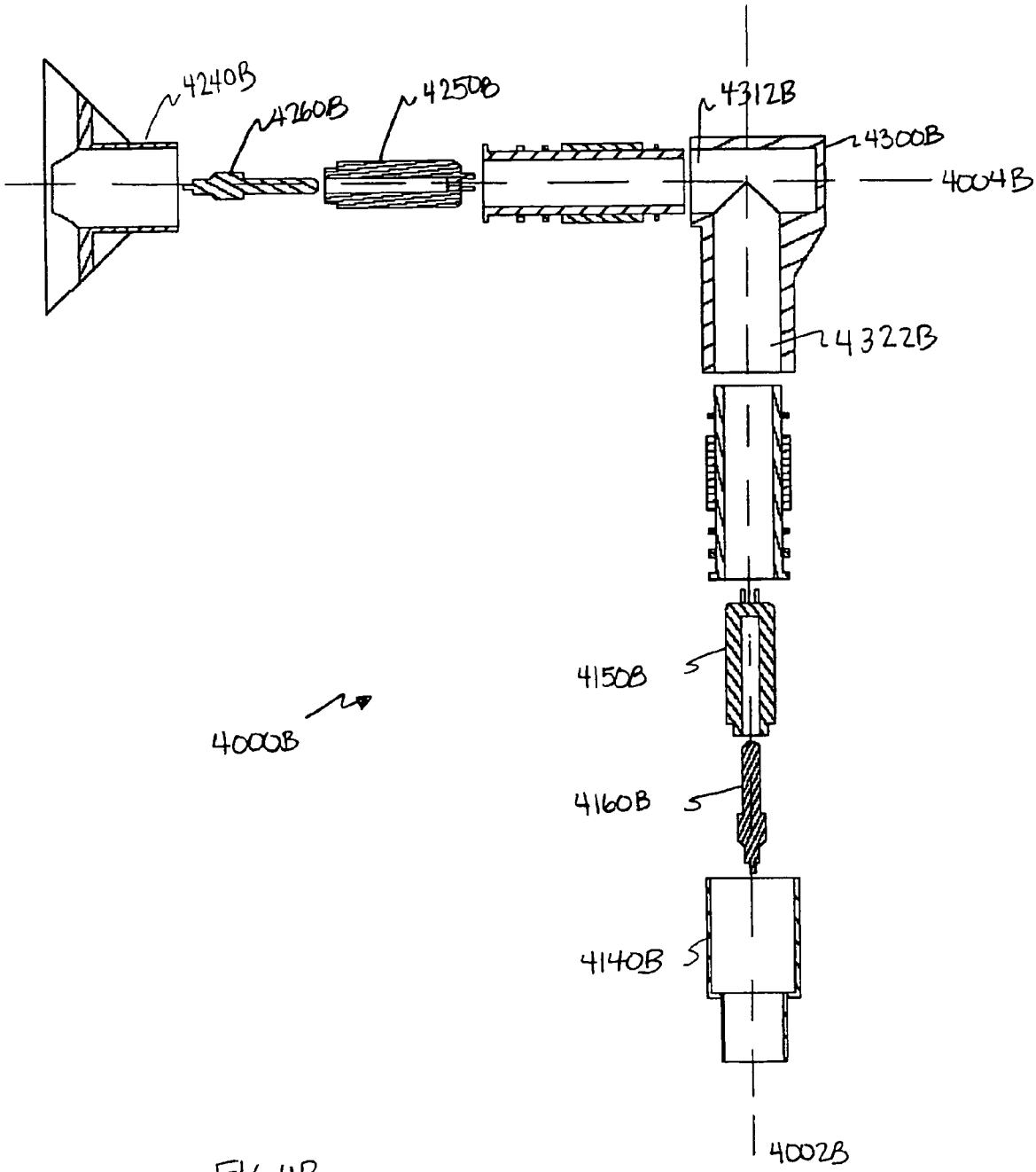
FIG. 4B is a cross-sectional view of components of a combination joint in accordance with another embodiment of this invention.

FIG. 4B is a cross-sectional view of components of a combination joint in accordance with another embodiment of this invention. Combination joint 4000B provides for electrical coupling as well as mechanical coupling. When the components of joint 4000B are assembled, electrical connector 4150B is fixed inside center house opening 4322B, and electrical connector 4160B is fixed inside transition housing 4140B.

Electrical connector 4150B couples to electrical connector 4160B. In one embodiment, electrical connector 4150B is a jack and electrical connector 4160B is a plug capable of rotating over 360 degrees relative to connector 4150B. For example, electrical connector 4150B may be a 2.5-mm jack and electrical connector 4160B may be a 2.5-mm plug. In another embodiment, connector 4150B is a plug and connector 4160B is a jack. In another embodiment, connectors 4150B, 4160B are coupled by threads, such that the rotation of connector 4150B relative to connector 4160B is dependent on the thread count. In such embodiments, connector 4150B may be capable of rotating 360 degrees in one direction several times before rotation may only occur in an opposite direction. In another embodiment, connectors 4150B and 4160B are connected using pin-in-slot caps, such that the rotation of connector 4150B relative to connector 4160B depends on the arclength of the slot. In one embodiment, connector 4150B is capable of rotating less than 360 degrees relative to connector 4160B.

Electrical connectors 4150B, 4160B may have any number of conductors (e.g. one conductor, or at least two conductors). For example, in one embodiment, electrical connectors 1150A, 1160A each have three conductors and may be used in, e.g., audio equipment. In another embodiment, electrical connectors 1150A, 1160A each have four conductors and may be used in, e.g., lighting fixtures.

Electrical connector 4150B couples to electrical connector 4250B. In one embodiment, connector 4150B electrically couples to connector 4250B via at least one cable housed inside center housing 4300B. The cable remains stationary relative to center housing 4300B during rotation of either transition housing 4140B or transition housing 4240B (or structures coupled to the transition housings or coupled directly to the combination joint). In another embodiment, connector 4150B electrically couples to connector 4250B via a solid conductive core within center housing 4300B.

Figure 4C:
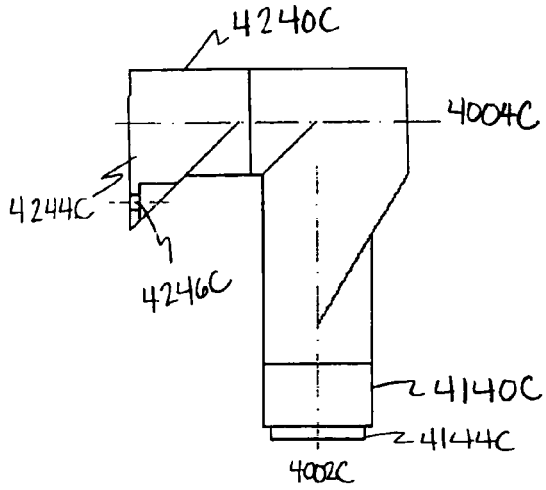
FIG. 4C is a side view of an assembled combination joint in accordance with one embodiment of this invention.

FIG. 4C is a side view of an assembled joint in accordance with one embodiment of this invention. Transition housing 4140C rotates relative to center housing 4300C along axis 4002C. Transition housing 4240C rotates relative to center housing 4300C along axis 4004C. Gusset 4244C extends in one direction away from axis 4004C. Gusset 4244C has opening 4246C through which fasteners (e.g. screws or nails) may secure combination joint 4000C to a structure (not shown). Transition housing end 4144C has a smaller outer diameter than the rest of transition housing 4140C.

Figure 4D:
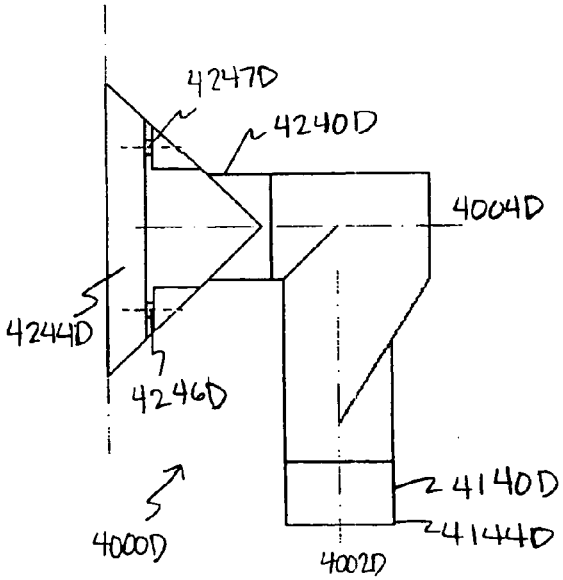
FIG. 4D is a side view of an assembled combination joint in accordance with another embodiment of this invention.

FIG. 4D is a side view of an assembled joint in accordance with another embodiment of this invention. Transition housing 4140D rotates relative to center housing 4300D along axis 4002D. Transition housing 4240D rotates relative to center housing 4300D along axis 4004D. Gusset 4244C extends in two directions away from axis 4004D. Gusset 4244D has openings 4246D, 4247D through which fasteners (e.g. screws or nails) may secure combination joint 4000D to a structure (not shown). Transition housing end 4144D has a diameter substantially equal to the rest of transition housing 4140D.

Figure 4E:
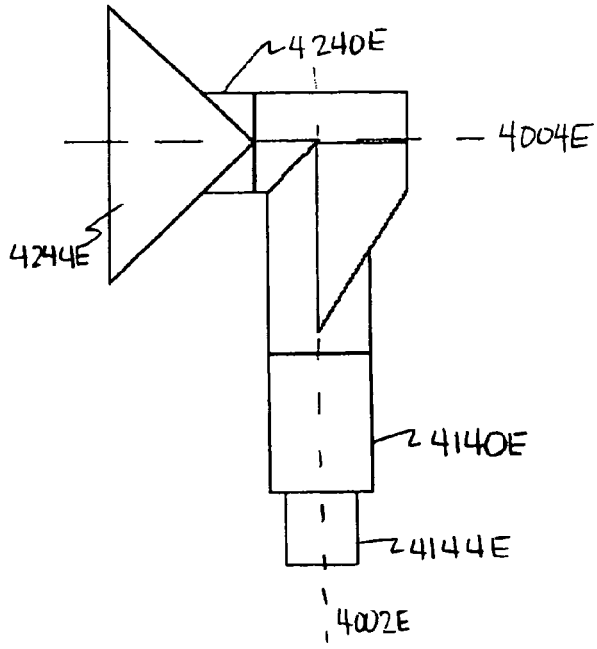
FIG. 4E is a side view of an assembled combination joint in accordance with another embodiment of this invention.

FIG. 4E is a side view of an assembled joint in accordance with another embodiment of this invention. Transition housing 4140E rotates relative to center housing 4300E along axis 4002E. Transition housing 4240E rotates relative to center housing 4300E along axis 4004E. Gusset 4244E extends in multiple directions away from axis 4004E. Gusset 4244E secures combination joint 4000E to a part (not shown) without fasteners (e.g. screws or nails). Transition housing end 4144E has a smaller outer diameter than the rest of transition housing 4140E. It shall be appreciated that a gusset within the scope of this invention may have any combination of one or more of the features previously described with regard to gussets.

Figure 5A:
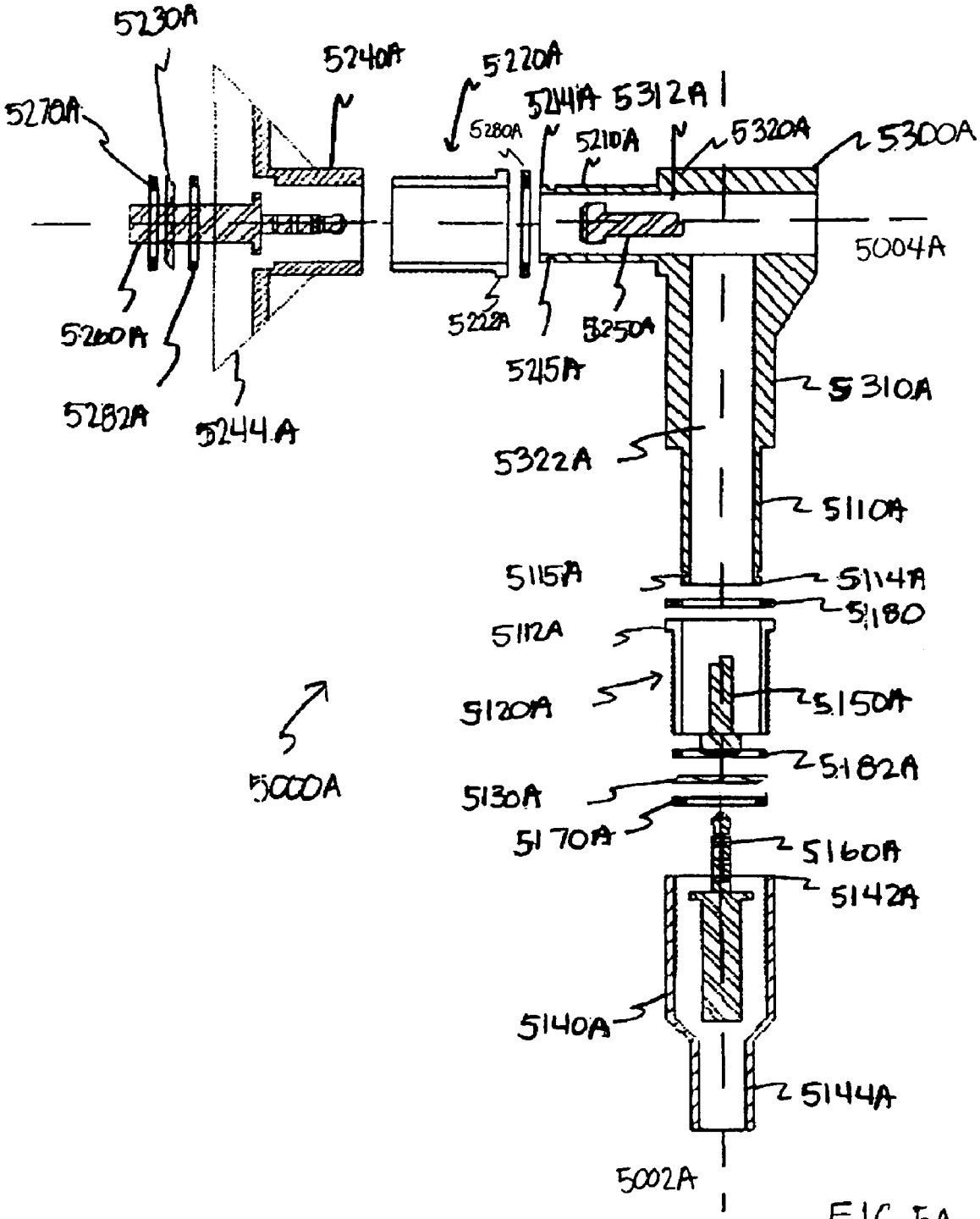
FIG. 5A is a cross-sectional view of components of a combination joint in accordance with one embodiment of this invention.

FIG. 5A is a cross-sectional view of components of a combination joint in accordance with one embodiment of this invention. Combination joint 5000A provides for both mechanical coupling and electrical coupling. Combination joint 5000A provides two degrees of freedom of mechanical motion, rotation around axis 5002A and rotation around axis 5004A. When the components of joint 5000A are assembled, electrical connector 5150A is fixed inside center house opening 5322A, and electrical connector 5160A is fixed inside transition housing 5140A. Electrical connector 5150A couples to electrical connector 5160A.

In this embodiment, barrel housings 5110A, 5210A are part of center housing 5300A. Grooves 5115A, 5215A near barrel housing ends 5114A, 5214A are sufficiently deep and wide to secure, respectively, retaining rings 5170A, 5270A to barrel housings 5110A, 5210A. When the components of joint 5000A are assembled, retaining rings 5170A, 5270A fit into grooves 5115A, 5215A. Retaining rings 5170A, 5217A have an inner diameter smaller than the outer diameter of barrel housings 5110A, 5210A. Retaining rings 5170A, 5270A have an outer diameter larger than the outer diameter of barrel housings 5110A, 5210A, but smaller or equal to the inner diameter of transition housings 5140A, 5240A. Retaining rings 5170A, 5270A restrict translational movement of spring waves 5130A, 5230A and bushings 5120A, 5220A along axes 5002A, 5004A on barrel housings 5110A, 5210A, respectively.

As assembled, bushings 5120A, 5220A are disposed around barrel housings 5110A, 5210A, respectively. Bushing ends 5122A, 5222A are adjacent to frictional washers 5180A, 5280A, which are adjacent to center housing 5300A. In another embodiment, bushing ends 5122A, 5222A frictionally contact center housing 5300A.

In the embodiment shown in FIG. 5A, bushings 5120A, 5220A are externally threaded. The threads on bushings 5120A, 5220A correspond to internal threads in transition housings 5140A, 5240A, respectively. The threads on bushing 5120A and transition housing 51402, and bushing 5220A and transition housing 5240A, allow each bushing-transition housing pair to be essentially screwed together.

Electrical connector 5150A couples to electrical connector 5250A. In one embodiment, connector 5150A electrically couples to connector 5250A via at least one cable housed inside center housing 5300A. The cable remains stationary relative to center housing 5300A during rotation of either transition housing 5140A or transition housing 5240A. In another embodiment, connector 5150A electrically couples to connector 5250A via a solid conductive core within center housing 5300A.

Figure 5B:
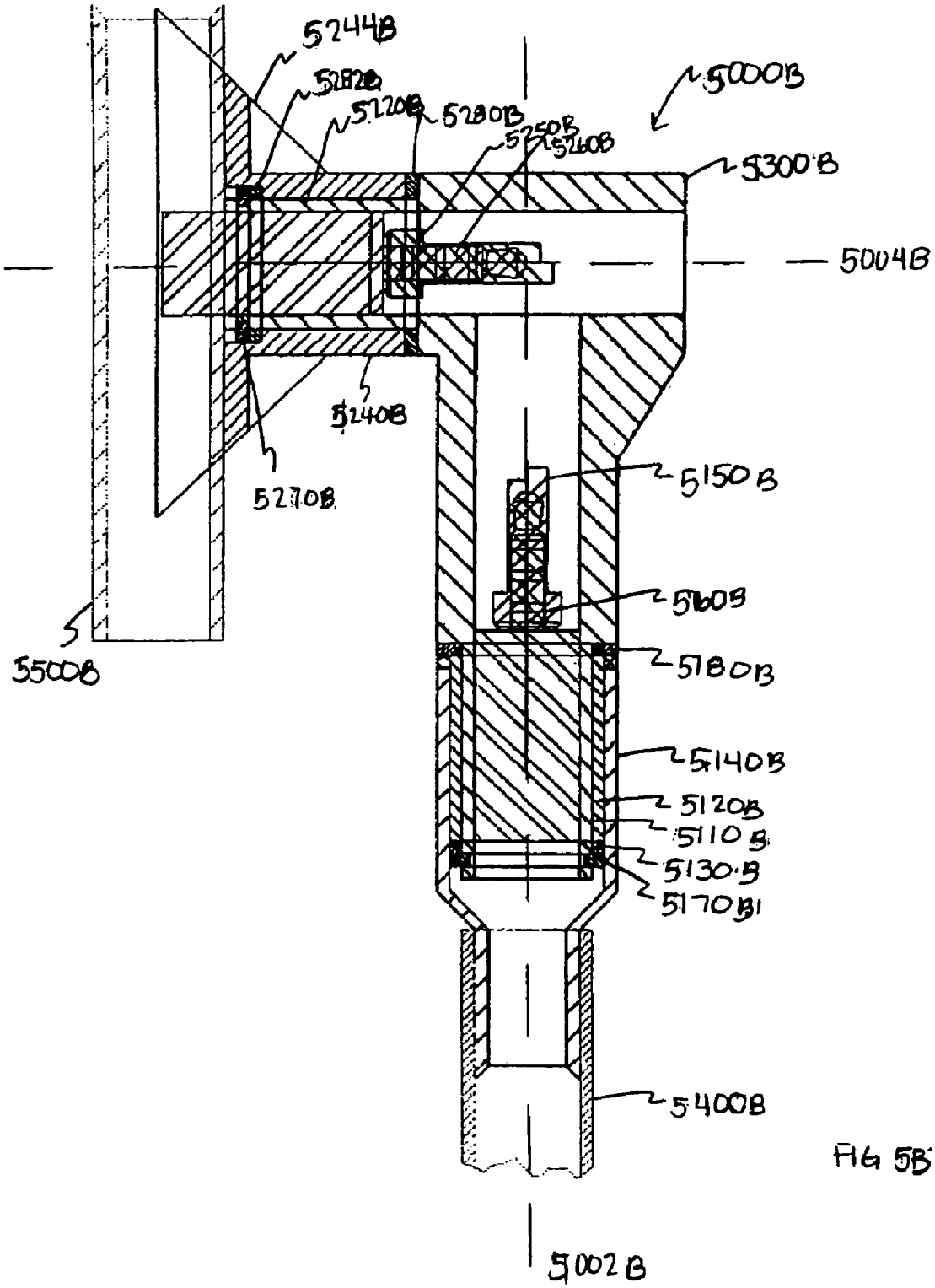
FIG. 5B is a cross-sectional view of the components of FIG. 5A coupled to each other and to two structures.

FIG. 5B is a cross-sectional view of the components of FIG. 5A coupled to each other and structures 5400B and 5500B. Structure 5400B couples axially along axis 5002B to transition housing 5140B over a narrower transition housing end. Structure 5500B couples orthogonally to axis 5004B to transition housing 5240B via gusset 5244B. Electrical connector 5260B extends through structure 5500B to permit coupling to an electrical component (not shown) housed inside structure 5500B. In another embodiment, an electrical component housed inside structure 5500B extends into transition housing 5240B to couple to electrical connector 5260B.

Figure 6:
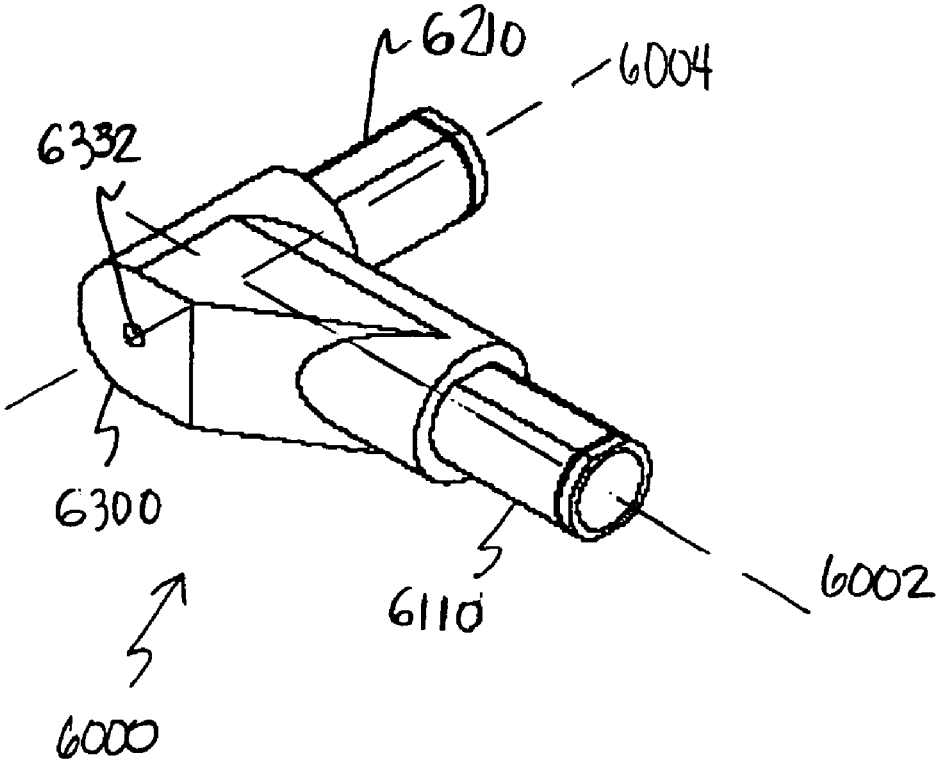
FIG. 6 is a perspective view of a combination joint component in accordance with another embodiment of this invention.

FIG. 6 is a perspective view of a combination joint in accordance with one embodiment of this invention. Center housing 6300 has opening 6332 along axis 6004. Opening 6332 permits another structure (e.g. a rod) to fixedly attach to combination joint 6000. In one embodiment opening 6332 is threaded to correspond to a threaded structure (e.g. a rod). In one embodiment, opening 6332 permits a third barrel housing to couple to center housing 6300. The barrel housing may then couple to a third transition housing to permit a third structure to rotate about axis 6300.

Figure 7:
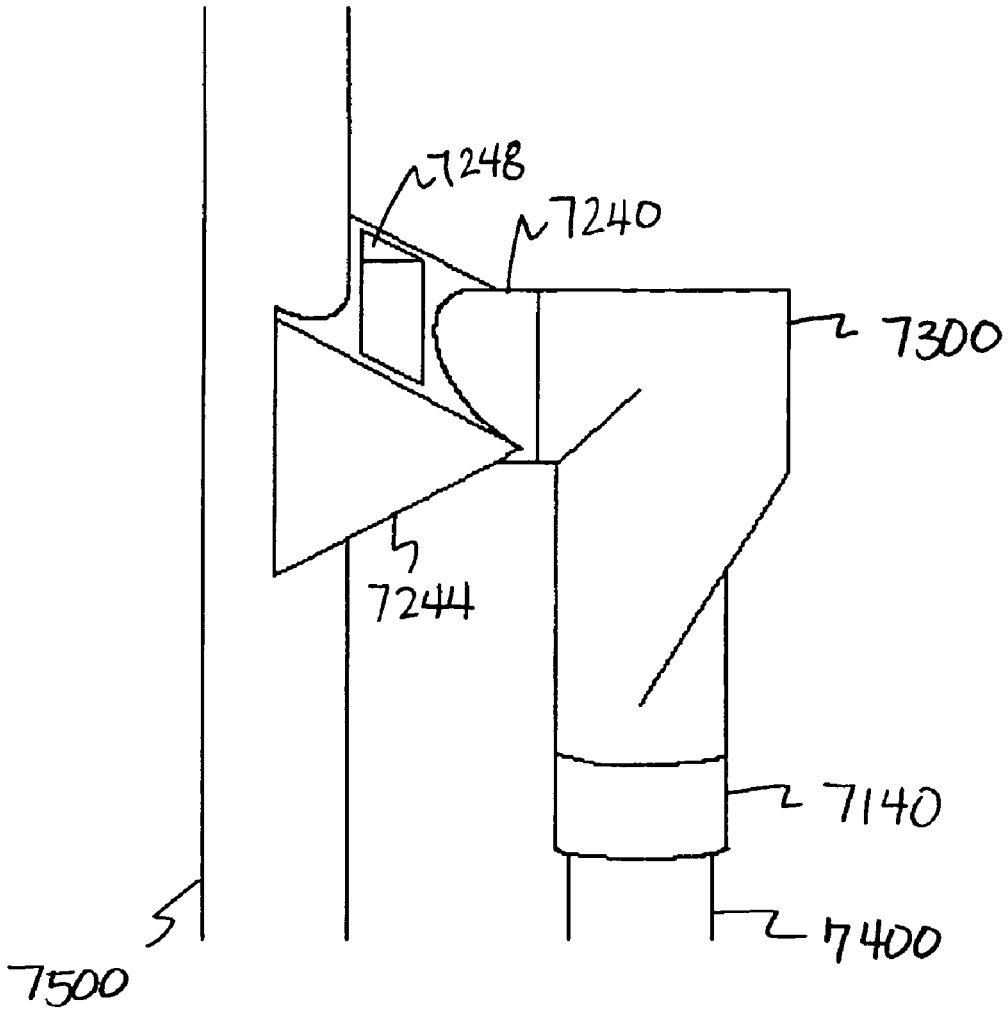
FIG. 7 is a perspective view of a combination joint in accordance with another embodiment of this invention coupled to two structures.

FIG. 7 is a perspective view of a combination joint, coupled to structures 7400, 7500, in accordance with another embodiment of this invention. Structure 7400 couples to transition housing 7140 axially. Structure 7500 couples to the combination joint orthogonally via transition housing 7240. A fastener may enter through opening 7248 to fit through another opening (not shown) in gusset 7244, and secure gusset 7244 to structure 7500. It will be appreciated that other methods (e.g. adhesives and press fitting) previously described for securing the joint to external structures (e.g. structures 7400, 7500) may also be used. It will also be appreciated that either structure 7400 or 7500 may have features permitting the structure to couple to the combination joint without a transition housing. For example, structure 7400 may be a pipe with an inner diameter that fits around the combination joint bushing, making a transition housing unnecessary.

Figure 8:
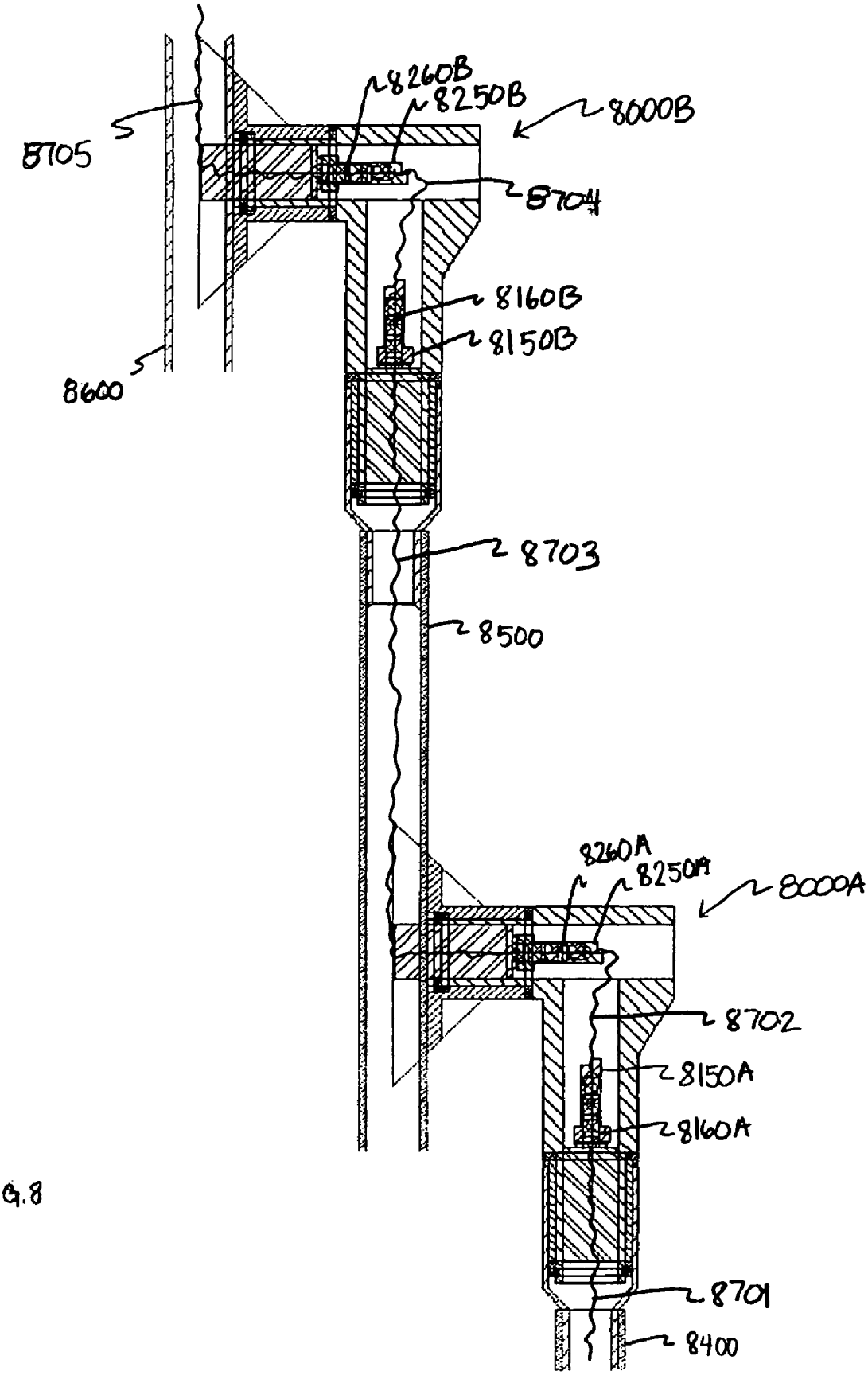
FIG. 8 is a cross-sectional view of electrical cables housed within combination joints and structures in accordance one embodiment of this invention.

FIG. 8 is a cross-sectional view of electrical cables housed within combination joints 8000A, 8000B in accordance with one embodiment of this invention. In FIG. 8, rod 8400 mechanically couples to combination joint 8000A, which mechanically couples to rod 8500. Rod 8500, in turn, mechanically couples to combination joint 8000B, which mechanically couples to rod 8600.

Cable 8701 (housed within rod 8400) electrically couples to combination joint 8000A via electrical connector 8160A, which electrically connects to connector 8150A. In the embodiment shown in FIG. 8, electrical connectors 8150A, 8160A are capable of rotating relative to each other. Electrical connectors 8510A, 8160A may be any electrical connectors with electrical contacts concentric about the axis of rotation. For example, electrical connector 8150A may be a jack and electrical connector 8160A may be a plug. Electrical connector 8150A also electrically connects to electrical cable 8702 (housed within combination joint 8000A.)

Cable 8702 electrically connects to electrical connector 8250A, which connects to connector 8260A. Connector 8260A also connects to cable 8703 (housed within rod 8500.) Cable 8703 electrically connects to electrical connector 8160B, which connects to electrical connector 8150B. Electrical connector 8150B also electrically connects to electrical cable 8704 (housed within combination joint 8000B.) Cable 8704 electrically connects to electrical connector 8250B, which connects to electrical connector 8260B. Electrical connector 8260B also electrically connects to cable 8705 (housed within rod 8600.)

Therefore, through combination joints 8000A and 8000B and electrical connectors 8150A, 8160A, 8250A, 8260A, 8150B, 8160B, 8260B and 8250B, cable 8701 electrically couples to cable 8705. Furthermore, none of the structures that facilitate electrical coupling between cable 8701 and 8705 (e.g. electrical connectors and cables 8702, 8703 and 8704) need be exposed along the path from rod 8400 (which houses cable 8701) to rod 8600 (which houses 8705).

Additionally, in the embodiment shown in FIG. 8, because electrical connectors 8150A, 8250A, 8150B and 8250B are capable of rotating relative to connectors 8160A, 8260A, 8160B and 8260B, respectively, cables 8701, 8702, 8703, 8704 and 8705 may maintain electrical connectivity without experiencing significant mechanical stress (e.g. due to twisting, stretching or bunching) when rods 8400, 8500 and 8600 move relative to each other and to combination joints 8000A and 8000B.

Thus, an apparatus for movably joining parts is disclosed. Although the present invention is described herein with reference to a specific preferred embodiment, many modifications and variations therein will readily occur to those with ordinary skill in the art. Accordingly, all such variations and modifications are included within the intended scope of the present invention as defined by the following claims.

What is claimed is:

1. A connecting device, comprising:

a barrel housing having a first end and a second end;

a first electrical connector disposed within the barrel housing capable of rotatably coupling to a second electrical connector;

a spring washer disposed around the barrel housing near the first end; and a bushing rotatably disposed around the barrel housing between the spring washer and the second end.

2. A connecting device of claim 1, wherein the first electrical connector is a four-conductor jack capable of rotatably coupling to a four-conductor plug and wherein the connecting device is coupled to a light generating device.

3. A connecting device of claim 1, wherein the first end of the barrel housing comprises a detachable retaining washer to provide a larger outer diameter at the first end relative to the second end.

4. A connecting device of claim 1, wherein the bushing is capable of rotating less than 360 degrees relative to the barrel housing.

5. A connecting device of claim 1, further comprising a transition housing disposed around the first end of the barrel housing and the spring washer, the transition housing having a first portion coupled to the bushing.

6. A connecting device of claim 5 wherein the transition housing comprises a gusset to attach to a rod which is substantially nonparallel to the transition housing.

7. A connecting device of claim 5, the transition housing further having a second portion smaller in outer diameter than the first portion, the second portion to attach to a rod to be disposed substantially parallel to the transition housing.

8. A connecting device of claim 1, further comprising:

a first friction washer disposed around the barrel housing between the spring washer and the bushing; and a second friction washer disposed around the barrel housing between the bushing and the second end.

9. A connecting device, comprising:

a first rotatable joint coupled to a center housing;

a first electrical connector coupled to a second electrical connector, the first and second electrical connectors disposed within the first rotatable joint and capable of rotating relative to each other;

a second rotatable joint coupled to the center housing at an angle relative to the first rotatable joint;

a third electrical connector coupled to a fourth electrical connector, the third and fourth electrical connectors disposed within the second rotatable joint and capable of rotating relative to each other; and a set of electrical conductors stationarily disposed within the center housing to connect the second electrical connector to the fourth electrical connector.

10. A connecting device of claim 9 wherein the second rotatable joint is capable of rotating at least 360 degrees relative to the center housing.

11. A connecting device of claim 9, wherein the second rotatable joint is capable of rotating less than 360 degrees relative to the center housing and wherein the set of electrical conductors remain stationary while either of the first rotatable joint and the second rotatable joint is rotated.

12. A connecting device of claim 9, wherein the first and third electrical connectors are plugs and the second and fourth electrical connectors are jacks and wherein the connecting device is coupled to a light generating device.

13. A connecting device of claim 12 wherein the plugs have at least two conductors and the jacks have at least two conductors.

14. A connecting device of claim 12 wherein the plugs have at least three conductors and the jacks have at least three conductors.

15. A connecting device of claim 12 wherein the connecting device couples a first rod to a second rod.

16. A connecting device, comprising:

a center housing having a first cylindrical end at an angle relative to a second cylindrical end;

a first bushing rotatably disposed around the first cylindrical end;

a first spring washer disposed around the first cylindrical end and adjacent to the first bushing;

a first retaining ring disposed around the first cylindrical end and adjacent to the first spring washer;

a first transition housing having a first portion disposed around the first retaining ring and first spring washer, the first transition housing coupled to the first bushing;

a second bushing rotatably disposed over the second cylindrical end;

a second spring washer disposed around the second cylindrical end and adjacent to the second bushing;

a second retaining ring disposed around the second cylindrical end and adjacent to the second spring washer; and a second transition housing having a first portion disposed around the second retaining ring and second spring washer, the second transition housing coupled to the second bushing.

17. A connecting device of claim 16, wherein the first cylindrical end is disposed ninety-degrees relative to the second cylindrical end.

18. A connecting device of claim 16, wherein the first transition housing further is to have a second portion smaller in diameter than the first portion to connect a rod axially to the first transition housing.

19. A connecting device of claim 16, wherein the second transition housing comprises a gusset to connect a rod perpendicular to the second transition housing.

20. A connecting device of claim 16, furthering comprising:

a first set of two friction washers disposed on opposing sides of the first bushing; and a second set of two friction washers disposed on opposing sides of the second bushing.

21. A connecting device of claim 16, furthering comprising:

a first position plug disposed within the first transition housing electrically coupled to a first position jack disposed within the first cylindrical end;

a second position plug disposed within the second transition housing electrically coupled to a second position jack disposed within the second cylindrical end; and a cable stationarily disposed within the center housing coupling the first jack to the second jack.

* * * * *